US011071351B2

(12) United States Patent
Giorgini

(10) Patent No.: US 11,071,351 B2
(45) Date of Patent: Jul. 27, 2021

(54) FOOTWEAR UPPER

(71) Applicant: Trerè Innovation S.r.l., Asola (IT)

(72) Inventor: Fabio Giorgini, Monticelli Brusati (IT)

(73) Assignee: TRERÈ INNOVATION S.R.L., Asola (IT)

( * ) Notice: Subject to any disclaimer, the term of this patent is extended or adjusted under 35 U.S.C. 154(b) by 55 days.

(21) Appl. No.: 16/304,844

(22) PCT Filed: May 30, 2017

(86) PCT No.: PCT/IT2017/000107

§ 371 (c)(1),
(2) Date: Nov. 27, 2018

(87) PCT Pub. No.: WO2017/208273

PCT Pub. Date: Dec. 7, 2017

(65) Prior Publication Data

US 2020/0315296 A1 Oct. 8, 2020

(30) Foreign Application Priority Data

Jun. 1, 2016 (IT) ..... 102016000056573

(51) Int. Cl.
*A43B 23/02* (2006.01)
*A43B 1/04* (2006.01)
(Continued)

(52) U.S. Cl.
CPC ..... *A43B 23/0225* (2013.01); *A43B 1/04* (2013.01); *A43B 9/02* (2013.01); *A43B 23/042* (2013.01)

(58) Field of Classification Search
CPC ..... A43B 23/025; A43B 23/042; A43B 1/04; A43B 9/02; A43B 23/0225
See application file for complete search history.

(56) References Cited

U.S. PATENT DOCUMENTS 4,559,722 A * 12/1985 Norton ..... A43B 5/06 36/105
5,345,638 A * 9/1994 Nishida ..... A41H 3/08 12/146 C (Continued)

FOREIGN PATENT DOCUMENTS

WO 92/22223 12/1992
WO 2015/037540 3/2015

OTHER PUBLICATIONS

International Search Report dated Oct. 20, 2017 in International (PCT) Application No. PCT/IT2017/000107.

*Primary Examiner* — Ted Kavanaugh
(74) *Attorney, Agent, or Firm* — Wenderoth, Lind & Ponack, L.L.P.

(57) ABSTRACT

A footwear upper is made of a knitted engineered fabric. The footwear upper includes a front portion for covering an upper part of a foot, an intermediate portion corresponding to an insole, and a rear portion for covering a heel. The front portion, the intermediate portion and the rear portion are produced with an engineered fabric composed of an internal core and a pair of external layers of knitted fabric. The footwear upper is made as one piece, is already contoured during a machining stage and is ready to be applied to a sole without any other type of machining, except for the possibility of sealing for joining the front portion to the rear portion laterally.

12 Claims, 3 Drawing Sheets

(51) Int. Cl.
*A43B 9/02* (2006.01)
*A43B 23/04* (2006.01)

(56) References Cited

U.S. PATENT DOCUMENTS

| | | | | |
|---|---|---|---|---|
| 5,896,758 | A * | 4/1999 | Rock | A43B 1/04 66/191 |
| 8,997,530 | B1 * | 4/2015 | Podhajny | A43B 1/04 66/177 |
| 2008/0110049 | A1 | 5/2008 | Sokolowski et al. | |
| 2010/0077634 | A1 | 4/2010 | Bell | |
| 2013/0291399 | A1 * | 11/2013 | Fonte | A43B 7/141 36/44 |
| 2014/0068968 | A1 * | 3/2014 | Podhajny | A43B 23/0255 36/50.1 |
| 2015/0052778 | A1 * | 2/2015 | Kirk | B32B 5/024 36/45 |
| 2016/0213097 | A1 | 7/2016 | Uchikawa et al. | |
| 2017/0311650 | A1 * | 11/2017 | Hupperets | A41B 17/00 |

* cited by examiner

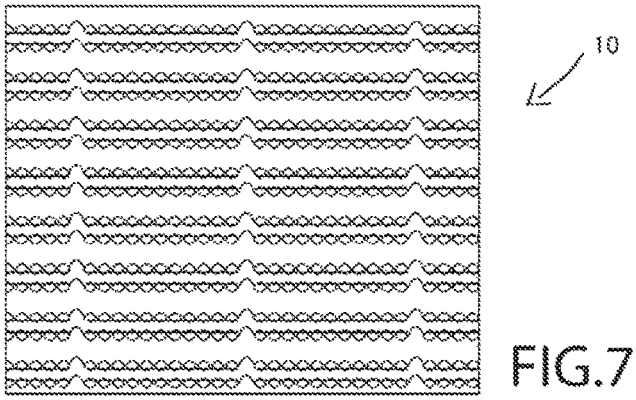
FIG.7
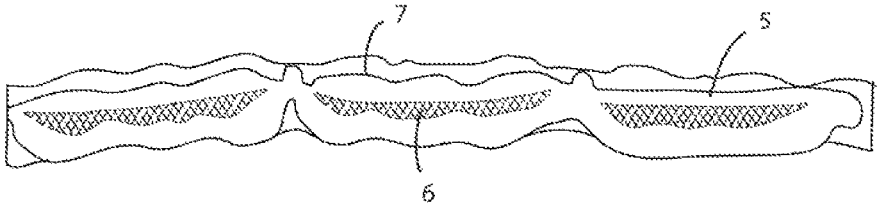
FIG.8
FIG.9
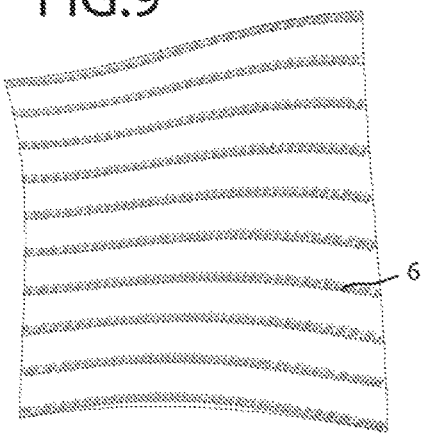
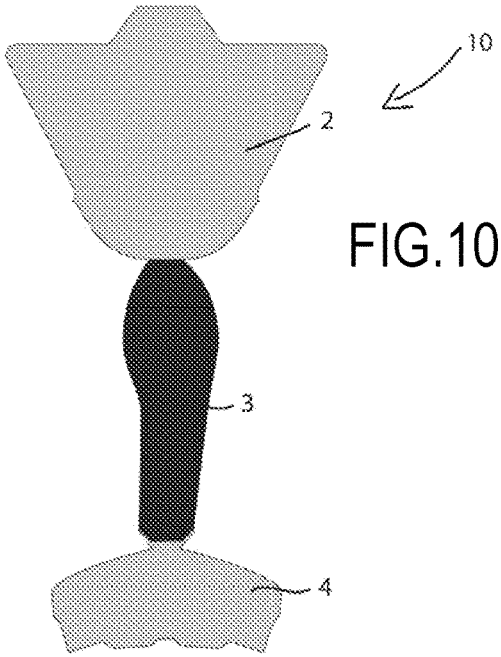
FIG.10
FIG.11
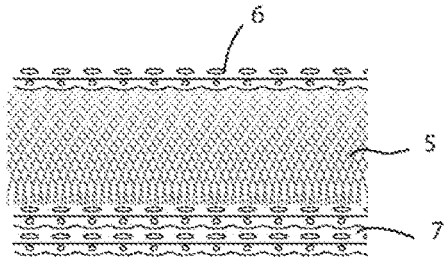

FOOTWEAR UPPER

TECHNICAL FIELD

The present invention relates to a footwear upper made of a knitted engineered fabric which is particularly suitable to guarantee good grip and protection for the foot.

BACKGROUND ART

As is known, footwear is a clothing accessory whose task is to protect feet and is essentially made up of a sole, which is the lower part which comes into contact with the ground, and an upper, which is the upper part and generally consists of several parts to cover the foot and hold the sole in position. In particular, the upper may have different ornaments, colours, and shapes and is attached to the sole by means of seams or gluing. Furthermore, in most cases, the upper is made of natural leather or synthetic materials.

In addition, footwear features an insole, which is the inner part that forms a cavity between the sole and the upper.

In fact, shoes are objects that have always been used to protect feet when the user is walking, running, etc., to prevent impacts injuring or causing fatigue in the bone and/or muscular structure of the foot.

At present, there are many types of shoes on the market and a major component thereof consists of sports shoes/casual shoes, which represent a large slice of the market.

Nowadays, in pursuit of ever-increasing specialisation, the performance which shoes offer and the technological features relating to the construction of the constituent parts of shoes are becoming increasingly advanced.

Among the various types available, there is a shoe that features an upper made of knitted fabric.

It is a football boot featuring a knitted upper, whose softness means it is referred to as a second skin. In particular, the knitted upper is covered with a thin layer of leather to protect the yarns and keep the surface soft, thereby ensuring that the boot provides maximum performance in any weather condition.

The boot just described features optimum comfort, but has revealed several shortcomings due to the delicacy of the upper, the tendency to wear thereof, and the poor protection of zones of the foot which are subject to impacts, not least given the type of use to which it is put. Furthermore, with use, the upper demonstrated low breathability and easy deformation of the structure thereof. In fact, a part of the drawbacks illustrated earlier are due to the fact that the thickness of the constituent fabric is constant, but the different parts of the foot require the fabric to have different levels of grip, resistance, and consistency.

In addition to the explanations so far, there is a demand expressed by the market for—for example—a shoe which features a knitted fabric with a knit which is capable of providing, at the same time, appropriate grip on the foot and protection in particular zones. In particular, the footwear is required to feature the fewest number of seams possible since, with time and prolonged use of the shoe, they irritate the foot and the pressure exerted thereby can create irritations that limit the wearability of the shoe.

As it is known, nowadays, there is a lot of interest among users in clothes and accessories which are comfortable, practical, functional, aesthetically pleasing, and flexible in terms of the use thereof.

Indeed, it is a known fact, for example, that sportsmen and women (among others) are particularly demanding and careful about their choices when it comes to the footwear, clothing, and accessories they use for their sporting activities, which means they refuse to accept compromises such as footwear which does not meet up to their expectations and needs, and which even sometimes wrongfully heightens expectations.

DISCLOSURE OF INVENTION

The aim of the present invention is essentially to solve the problems of the commonly known technique, overcoming the drawbacks described above by means of a one-piece, machine-finished, footwear upper without interruptions, seams or raw edges either around the edges or in other zones.

A second aim of the present invention is to provide a footwear upper which is able to adapt perfectly to the morphology of the foot as featuring differentiated thicknesses in the knit sequence achieved through differentiated interwoven sections in the machining.

A further aim of the present invention is to produce a footwear upper using a knitting machine, which allows the user to obtain optimum foot grip, excellent breathability, decidedly contained weight, support, and remarkable comfort when worn.

A still further aim of the present invention is to produce a footwear upper which features variable thickness inserts that offer support points with varying degrees of softness or hardness, as needed.

A still further aim of the present invention is to produce a footwear upper whose construction features alternating areas with varying degrees of padding, which are lightweight and perforated so as be breathable.

A further but not final aim of the present invention is to produce a footwear upper which is easy to manufacture and works well.

These aims and others besides, which will better emerge over the course of the present description, are essentially achieved by means of a footwear upper, as outlined in the claims below.

BRIEF DESCRIPTION OF DRAWINGS

Further features and advantages will better emerge in the detailed description of a footwear upper according to the present invention, provided in the form of a non-limiting example, with reference to the accompanying drawings, in which:

FIG. 7 shows, schematically, a detail of a further fabric comprising the footwear upper;

FIG. 8 shows, schematically, a section view of a fabric for a footwear upper;

FIG. 9 shows, schematically, a detail of a further fabric for an upper;

FIG. 10 shows, schematically, a top view of the form of a different upper according to the present invention;

FIG. 11 shows, schematically, a section view of a detail of a fabric for an upper.

Figure 1:
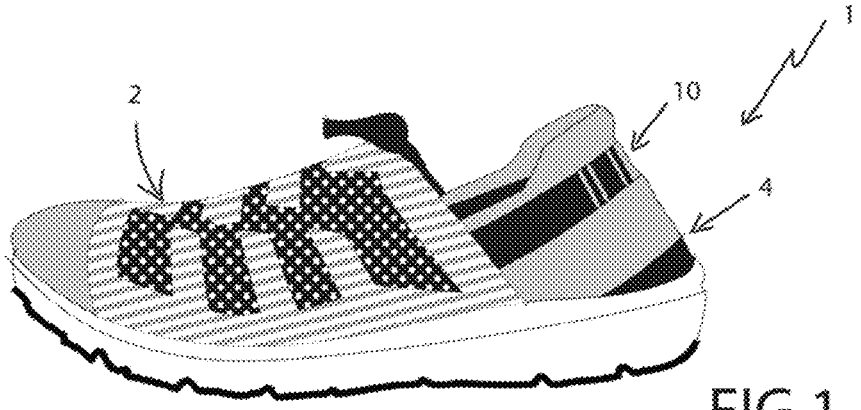
FIG. 1 shows, schematically and from a side view, a shoe with a footwear upper according to the present invention.
Figure 2:
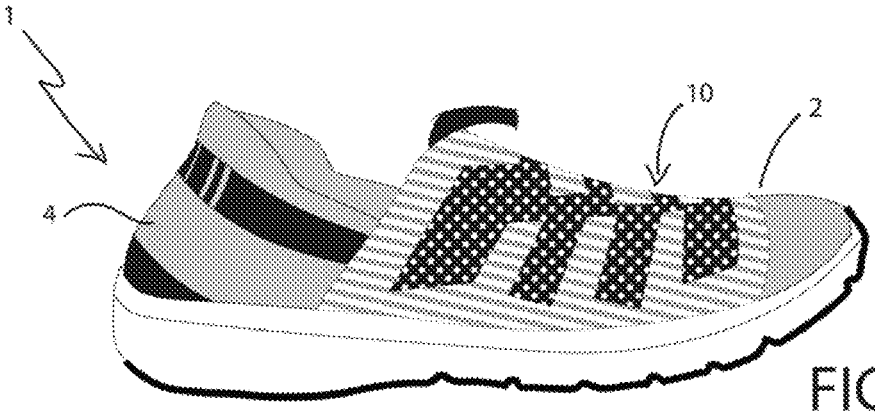
FIG. 2 shows, schematically, a further side view of the footwear upper in FIG. 1.

With reference to the figures stated, 1 denotes, as a whole, a shoe produced with a footwear upper according to the present invention.

BEST MODE FOR CARRYING OUT THE INVENTION

The upper 10 in question is essentially constituted of a front portion 2, an intermediate portion 3, and a rear portion 4.

The front portion 2 is envisaged to cover the upper part of the foot, the intermediate one 3 corresponds to the insole on which the lower part of the foot rests, and the rear one 4 is envisaged to cover the heel.

Figure 3:
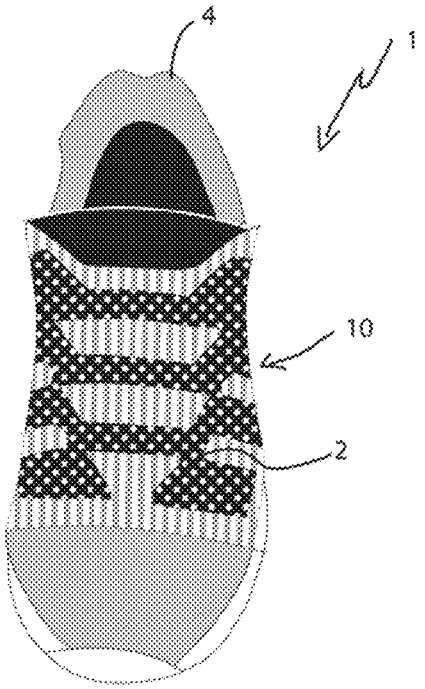
FIG. 3 shows, schematically, the front portion of the shoe in FIG. 1.

In greater detail, the front portion 2 features a substantially trapezoidal conformation and envisages a series of zones with different types of machining, as shown in FIG. 3, which allow the diversification of the various functions, such a breathability, containment, and support. In particular, in the front portion 2 there is a first zone 20 envisaged which comes into contact with the intermediate portion 3 and corresponds to the toe area, in addition to a second zone 21, which features various sectors with a rhombus configuration 210, whose function will be illustrated later on and which are envisaged to cover the upper part of the foot. Finally, the front portion 2 comprises a third zone 23, which serves as a tongue in the shoe to help the user don the item of footwear.

In particular, the third zone 23 is just the tip of the actual tongue, which is incorporated into the structure of the upper and is not separate therefrom (as it is in current shoes), which means the said tongue does not move and does not create a thickness which could lead to discomfort.

In particular, the zone of the front portion designed to serve as a "tongue" is endowed with adequate thickness and padding, which can vary according to the need to further protect the part consisting of the neck of the foot.

In more detail, the portion of fabric which performs the function of tongue is not only the third zone 23, which corresponds to the tip of the tongue, but also a part of the front portion, and is distinguished by a difference in machining and thickness. In fact, the front portion covers the entire upper part of the foot and the central portion, whose function is to protect the neck of the foot, features more padding. Furthermore, within the portion performing the tongue function, the padding can vary from one point to another, in order to provide optimum protection.

The intermediate portion 3 connects the first portion 2 and the third portion 4, and features an essentially rectangular but slightly contoured conformation which corresponds to the insole, where a first zone 30 corresponds to the sole of the foot, the second zone 31 to the instep, and the third zone 32 to the heel.

In greater detail, the first zone 30 envisages a first reinforced sector 30*a* corresponding to the support for the forefoot and likewise the third zone 32 has a second reinforced sector 32*a* corresponding to the resting area for the heel.

In particular, in zone 30, under the toes, there is a sector 30*b* present, endowed with particular perforation machining, which allows breathability, and greater thickness is envisaged between the perforated parts, to give greater comfort for the toes when resting, creating, at the same time, a sort of housing for the toes and a sort of guide for a correct fit.

In the intermediate portion 3, in correspondence with the instep, there is another perforated sector 31*a* present, to create a zone for aeration and air circulation to prevent the sole of the foot sweating.

In addition to the explanations so far and in accordance with the present invention, the intermediate portion 3, i.e. the insole, is constructed in such a way that the user's foot is held firm and does not move inside the shoe during movement by the user.

Furthermore, each lateral edge 23*a* or 23*b* of the said front portion 2 is envisaged to couple respectively with the lateral edge 33*a* or 33*b* of the second zone of the intermediate portion 3, while the front edge 24*a* and 24*b* is envisaged to join with the edge 34*a* and 34*b*.

Figure 4:
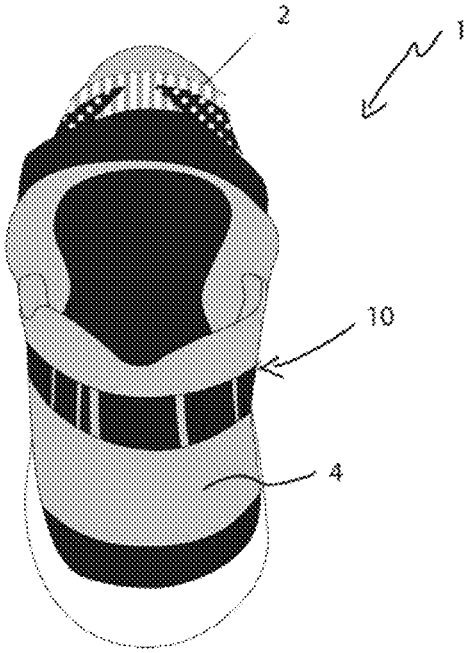
FIG. 4 shows, schematically, the rear portion of the shoe in FIG. 1.
Figure 5:
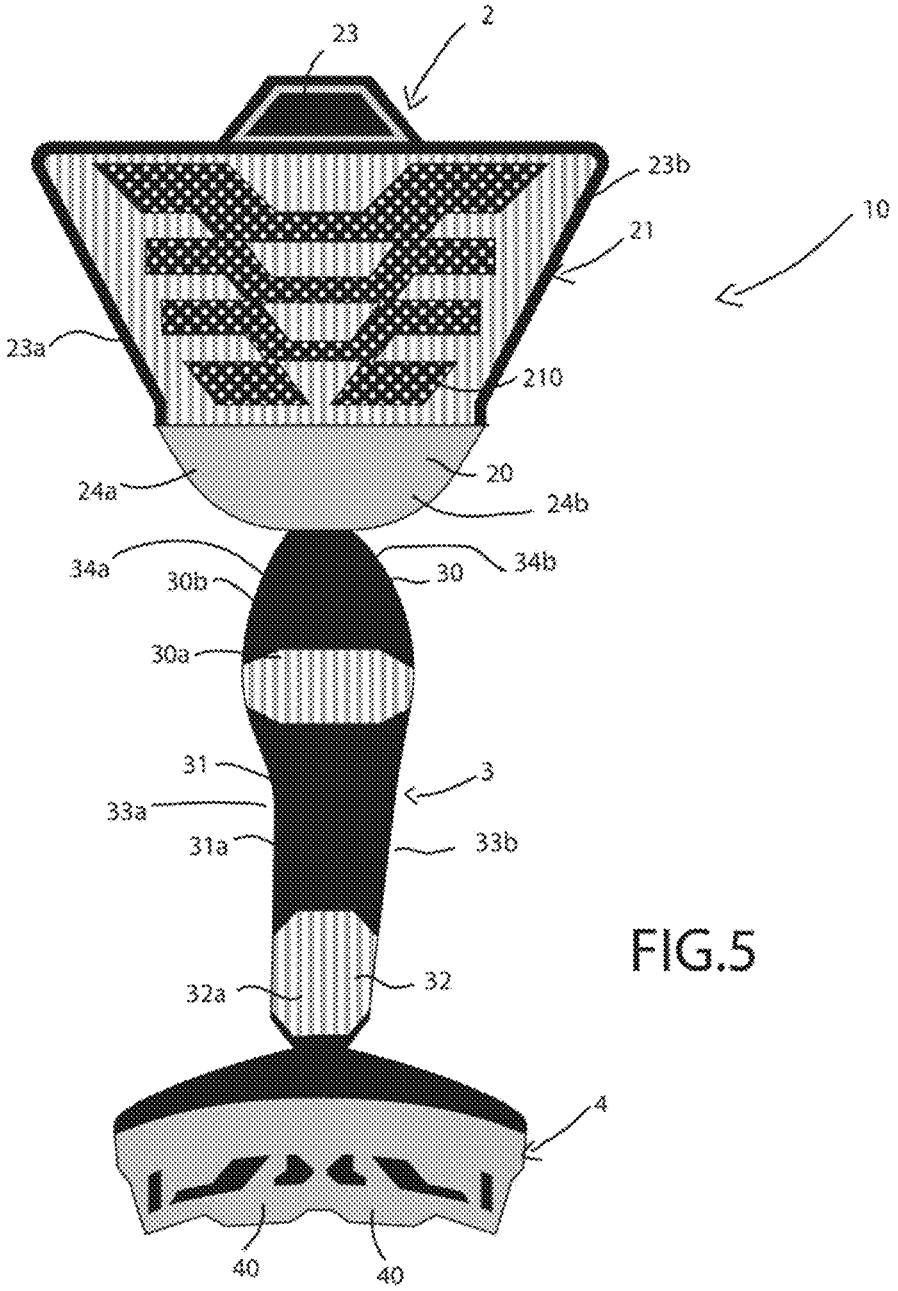
FIG. 5 shows, schematically, a top view of the form of the footwear upper in question.

According to the present embodiment, the rear portion 4 has a band configuration which is envisaged to laterally wrap the heel. As shown in FIG. 4, the free end of the rear portion 4 features a pair of tongues 40 which are envisaged to wrap the heel firmly, while the free space therebetween is used to leave the Achilles tendon free, thereby allowing good movement.

Similarly in the rear portion, to better protect the heel, the fabric comprising that part of the upper features differentiated and varying zones of padding; in fact, the padding can vary from one point to another point in order to provide optimum protection.

According to the present embodiment, the front portion 2, intermediate portion 3, and rear portion 4 are produced using an engineered fabric composed of an internal core 5 and a pair of external layers 6 and 7 of knitted fabric. The external layers 6 and 7 which cover the core feature different thicknesses due to the use of different yarns, as well as the type of machining carried out on the same row.

In fact, the fabric can be manufactured with various types of yarns, including yarns interwoven with one other (with reference to both the core and the external layers).

In particular, the yarn employed for the production of the external layers is a natural or synthetic yarn, a combination of the two types, or an interweaving of different types and thicknesses of yarn.

In particular, by varying the weave on the same row, different thicknesses can be obtained from different machining and such condition lends the fabric structural features which differ from one point to another point, as well as in terms of end performance.

In addition to the explanations so far, the fabric features a core made of a synthetic material, such as polyester, nylon, and others with equivalent features, consisting of a yarn with particular machining which acts as a cavity and a connection between the two external layers. The machining to form the yarn which comprises the core consists of an interweaving of the yarn used in the knit, whose final effect is a kind of zigzagging of the yarn, which engages once with the internal side of one layer and then again with the internal side of the other (external) layer of knitted fabric, as shown in detail in FIG. 11. In greater detail, the structure of the core consists of interwoven yarns anchored to the external layers so as to create a mesh which can vary in height, and therefore, in terms of core thickness, yarn density, and yarn spacing.

In fact, a less dense distribution of the yarns creates a softer, airier, and more breathable core, while a denser, more compact distribution of the yarns make a stiffer and more stress-resistant core.

In addition, if one alters the thickness of the yarn used to create the core, the features of the yarn change proportionally.

Figure 6:
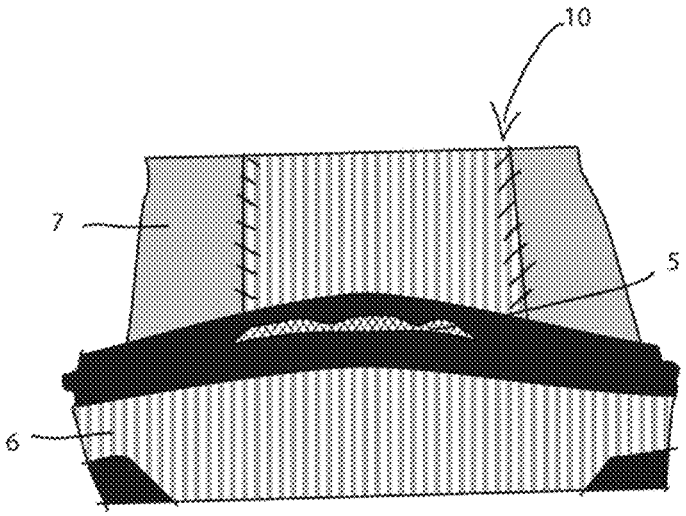
FIG. 6 shows, schematically, a detail of the fabric comprising the footwear upper in FIG. 1.

As mentioned earlier and as shown in FIG. 6, the core is covered by two layers of full fabric 6, 7, the said fabric being produced with a knitting machine with several needle beds.

In particular, the core 5 has a climate control function as it creates a cavity between the two external layers and sectors are obtained which are cooler or warmer and/or varyingly breathable depending on the thickness of the core.

In accordance with the present invention, the fabric may have different internal thicknesses which allow for a more specific and sectoral design of the piece, thereby also allowing the product to be given specific technical features at points of need.

In fact, for example, the thickness of the core allows the fabric to have controlled flexibility and the thicker the core is, the more flexible and softer the fabric is.

The denser the weave of the core is, the more compression-resistant it is, since the fabric is stiffer overall.

In addition, the greater the density of the yarns woven together to form the core, the more padded and stiffer the fabric is, thereby guaranteeing greater support and, consequently, better comfort. Furthermore, the zones with more padding provide greater protection.

In addition to the explanations so far, the thicker the core, the more the fabric offers optimum climate control for the foot, as the way in which the core is produced means it is endowed with open channels that allow better and greater air circulation and therefore better climate control as where the core is thicker, the air circulates better and more easily, keeping the temperature even and constant, while when the air reaches an area which is less thick and the weave is denser, the air slows down, resulting in a temperature increase as there is less possibility of dispersion. In this way, differentiated comfort zones are possible.

In addition to the above, when the core is less thick, the fabric can provide greater support to the contact area since the said fabric is stiffer and more compact. Furthermore, less thickness allows the fabric to be more resistant to pressure and impacts and external stress.

In particular, greater thickness better absorbs light yet prolonged stress, as it has a more elastic response, while less thickness absorbs shorter but more intense stress.

As mentioned earlier, the core is covered by two external layers of fabric, which are produced with a knitting machine with several needle beds. Furthermore, the layers can be the same on both sides or can be machined differently.

Furthermore, one side may have one type of machining while the corresponding one, on the opposite side, is different. In fact, for example, one layer can be endowed with openings to create zones with particular breathability in order to capture heat and/or humidity from the foot if placed inside.

The fabric, on the other hand, which is a full fabric located externally, prevents the inlet of humidity and drastically reduces the possibility of water getting inside.

In particular, the presence of perforations and openings for the passage of air does not allow the inlet of powder, sand, etc. so nothing enters the shoe that could cause discomfort to the foot.

In addition to the explanations so far, when machining the external layer of the fabric, at least one pair of holes for inserting laces can be made in the front portion, the said laces acting to achieve a greater grip on and containment of the foot depending on the type of activities that the user carries out, such as football, running, trekking, or simply walking.

In particular, the front portion and the insole that contribute to the grip on the foot can be customised in such a way as to take into account both the morphological characteristics of the user's foot, the weight thereof, and the type of use.

Furthermore, within the contour of each layer of fabric, various knitting structures are used, such as jersey on both sides, rib knit, interlock knit, vanisé knit, jacquard knit, coloured jacquard knit, tuck stitch knit, open-work knit, cable knit, knits with a design, and knits with an inlaid design.

The said fabric being contoured as produced with knits which allow pre-shaping (anatomical) by means of different selections, yarns, and gauges.

Different types of machining allow the fabric obtained to have structural features that are transformed into functional features for footwear.

According to the present invention, the engineered fabric leaves the machining with the edging sealed, which means said fabric is stronger and less prone to damage because the yarns present inside cannot protrude therefrom and, at the same time, nothing can be inserted into the interior. Furthermore, the sealed edging facilitates the insertion of the edge of the engineered fabric into the rubber of the sole. In fact, since the edging is already sealed during machining, this allows it to be less thick and therefore the quality level is better, and it is more durable and does not require subsequent machining.

The fabric comes out of the machine already contoured which means that there is no other work to be done when the shoe is being made.

As mentioned earlier, the fabric—in all forms thereof—undergoes contouring already in the machining phase and comes out of the machine finished, ready to be applied to the sole without any other type of machining, except the sealing to join the first portion with the third laterally.

In addition, the engineered fabric can have different edgings depending on the needs.

As mentioned earlier, and to better illustrate the structural features of the engineered fabric comprising the shoe upper, at the pressure points (heel or toe) more resistant yarns are used to make the layer in that zone, to make the portion less prone to wear, and the same applies to the toe. In order to obtain particular features or performances in the different zones of the engineered fabric, it is possible to change both the structure and the material with which each zone is constructed.

All the inserts and the different types of structure of the engineered fabric comprising the upper are obtained during machining, which means there are no seams that can cause discomfort, irritations, or stress to the foot. As mentioned earlier, the only sealing envisaged is on the side, but this does not interfere or lead to discomfort of the foot since it is in a position that does not create problems.

In particular, there are no seams in the toe area and there are no inserts for inserting laces, as there are with current shoes, simply the perforations stated earlier.

In addition to the explanations so far, the engineered fabric according to the present invention is produced with the desired contouring, which means the upper is formed from a single piece, without any interruptions, seams (except the lateral sealing), hard edges and/or raw edges. In fact, the upper is constructed in a single machining phase and comes out of the machine complete, which means no subsequent steps are required, except the assembly thereof with the sole. In particular, the edging is soft and this condition makes the shoe fit comfortably, without the risk of irritation or blisters, as often occur with sports shoes, which have rather stiff edges which means they tend to cause discomfort in the long run.

After the predominantly structural description, the invention in question will now be outlined. When a user intends to walk or engage in a sport, he or she must simply don a pair of shoes according to the present invention and use them in exactly the same way as those currently in use, with the difference that the support in the various zones of the foot will differ from sector to sector, the comfort will be optimum and diversified according to the different points of the foot, the climate control will also differ from zone to zone and the toe and the heel will be protected against impacts and blows and the other parts of the foot will be helped and supported, as well as protected during the various movements.

Thus the present invention achieves the aims set.

The footwear upper in question is produced as a one-piece, machine-finished upper without interruptions, seams or raw edges either around the edging or in other zones.

Advantageously, the upper according to the present invention adapts perfectly to the morphology of the foot, features differentiated thicknesses on the same row of knitting, and features differentiated interweaving in the machining which produces footwear that offers optimum breathability with differentiated zones for aeration and air circulation as needed, a suitable housing for the toes, and protection of the parts of the foot against impacts and stress with an either stiffer or more flexible engineered fabric, depending on the needs for foot protection and comfort.

A further advantage of the upper is that it is produced using a knitting machine without the need for subsequent machining (except the assembly thereof with the sole), to give the user footwear which has optimum foot grip, excellent breathability, decidedly contained weight, support, and remarkable comfort when worn.

In addition to the explanations so far, the footwear upper in question features variable thickness inserts which provide the foot with support points with varying degrees of softness or hardness as needed.

Furthermore, the construction of the footwear upper according to the present invention involves alternating areas with varying degrees of padding, which are lightweight and perforated so as be breathable and provide heat regulation.

Advantageously, the upper in question does not have any additional components since it is made up of a single element—unlike, for example, the knitted upper shoes currently available on the market, which, for example, have an insert for inserting laces, as well as a cover for the knitted fabric, various seams, etc.

Advantageously, the upper according to the present invention adapts perfectly to the morphology of the foot, without any uncomfortable thickness, and features defined zones with greater grip and support.

Furthermore, the garment with elastic allows the user to obtain stimulation of the blood circulation, a massaging effect, optimum support, and also remarkable comfort when worn.

In addition, the upper allows for sectors and zones with varying degrees of flexibility or stiffness within the same sector.

Advantageously, the footwear with the upper according to the present invention allows for a considerable reduction in the mechanical stress on the user's skin, bones, muscles and tendons, in addition to preventing contusions in the foot.

One advantage achieved with the present footwear is that the user's performance improves since the elements of disturbance and discomfort are reduced, making the user much safer during the movements thereof.

A further advantage is due to the fact that the footwear upper in question is easy to manufacture and works well.

Naturally, further modifications or variants may be applied to the present invention while remaining within the scope of the invention that characterises it.

The invention claimed is:

1. A footwear upper comprising:

a front portion configured to cover an upper part of a foot;

an intermediate portion corresponding to an insole configured to support a lower part of the foot; and a rear portion configured to cover a heel of the foot, wherein:

each of the front portion, the intermediate portion and the rear portion is made of an engineered fabric composed of an internal core and a pair of external layers made of knitted fabric;

the front portion, the intermediate portion and the rear portion have different thicknesses resulting from use of different yarns, in addition to different processing methods;

the footwear upper is made as one piece, pre-shaped and ready to be applied to a sole;

a part of the front portion has a trapezoidal configuration and the front portion includes:

a first zone which is in contact with the intermediate portion and corresponds to a toe zone of the foot;

a second zone configured to cover the upper part of the foot; and a third zone, which corresponds to a tip of a tongue to help a user to don the footwear upper, wherein the first zone, the second zone and the third zone are formed differently.

2. The footwear upper according to claim 1, wherein the third zone of the front portion has a variable thickness and a padding.

3. The footwear upper according to claim 1, wherein:

the intermediate portion connects the front portion and the rear portion and a part of the intermediate portion has a rectangular, contoured configuration;

the intermediate portion includes a first zone corresponding to the sole, a second zone corresponding to an instep, and a third zone corresponding to the heel;

the first zone of the intermediate portion includes a first sector corresponding to a reinforced support for a forefoot and a second sector with perforations;

the first zone of the intermediate portion is thicker between the perforated parts;

the second zone of the intermediate portion includes a perforated sector in correspondence with the instep; and the third zone of the intermediate portion has a reinforced sector corresponding to a resting area for the heel.

4. The footwear upper according to claim 1, wherein:

the rear portion has a band configuration configured to laterally wrap the heel;

a free end of the rear portion includes a pair of tabs configured to wrap the heel with a free space therebetween for leaving an Achilles tendon free; and the rear portion is composed of a fabric with variable thickness padding.

5. The footwear upper according to claim 3, wherein:

lateral edges of the front portion are configured to respectively couple with lateral edges of the second zone of the intermediate portion; and front edges of the front portion are configured to respectively join with edges of the first zone of the intermediate portion.

6. The footwear upper according to claim 1, wherein:

yarn of the internal core serves as a cavity and a connection between the pair of external layers;

the yarn of the internal core is zigzagged and engaged with an internal side of a first of the pair of external layers and an internal side of a second of the pair of external layers so as to create a mesh of variable height, core thickness, yarn density, and yarn spacing; and edges of the engineered fabric are sealed.

7. The footwear upper according to claim 6, wherein the engineered fabric has a padding.

8. The footwear upper according to claim 6, wherein the internal core is thicker than each of the pair of external layers.

9. The footwear upper according to claim 6, wherein the internal core has a different yarn distribution than the pair of external layers.

10. The footwear upper according to claim 6, wherein the different yarns are interwoven.

11. The footwear upper according to claim 6, wherein at least one of the different yarns is natural.

12. The footwear upper according to claim 6, wherein at least one of the different yarns is synthetic.

* * * * *